US010524600B1

(12) United States Patent
Williams

(10) Patent No.: US 10,524,600 B1
(45) Date of Patent: Jan. 7, 2020

(54) DEVICE FOR ASSISTING USERS

(71) Applicant: Saundra J. Williams, Trotwood, OH (US)

(72) Inventor: Saundra J. Williams, Trotwood, OH (US)

( * ) Notice: Subject to any disclaimer, the term of this patent is extended or adjusted under 35 U.S.C. 154(b) by 0 days.

(21) Appl. No.: 15/917,309

(22) Filed: Mar. 9, 2018

(51) Int. Cl.
*A47G 25/06* (2006.01)
*A47B 46/00* (2006.01)

(52) U.S. Cl.
CPC ..... *A47G 25/0685* (2013.01); *A47B 46/00* (2013.01); *A47G 25/0664* (2013.01)

(58) Field of Classification Search
CPC . A47G 25/0685; A47G 25/0664; A47B 46/00
USPC ..... 211/1.51, 1.57
See application file for complete search history.

(56) References Cited

U.S. PATENT DOCUMENTS 983,589 A * 2/1911 Wendt ..... A47G 25/0664 211/172
984,591 A * 2/1911 Nelson ..... A47G 25/0664 211/196
1,042,262 A * 10/1912 Pelletier ..... A47F 5/06 206/9
1,075,395 A * 10/1913 Beegle ..... A47G 25/0664 211/196
1,729,395 A * 9/1929 Mandel ..... A47G 25/0664 211/172
1,748,597 A * 2/1930 Collins ..... A47G 25/0664 211/172
2,469,494 A * 5/1949 Bushko ..... A47G 25/0664 211/172
2,520,414 A * 8/1950 Kurtz ..... A47G 25/0664 211/171
2,587,111 A * 2/1952 Cashen, Jr. ..... A47G 25/0685 108/29
2,604,214 A * 7/1952 Fussell ..... A47F 7/24 211/165
2,789,703 A * 4/1957 Kurtz ..... A47B 57/045 211/171
4,073,383 A * 2/1978 Rummer ..... A47F 5/025 211/1.57
5,439,269 A * 8/1995 Cheng ..... A47C 4/02 108/150
5,695,072 A * 12/1997 Terragni ..... A47G 25/02 211/1.51

(Continued)

FOREIGN PATENT DOCUMENTS

CH 347315 A * 6/1960 ..... A47G 25/0685
DE 2624684 A1 * 11/1977 ..... A47B 9/04

(Continued)

*Primary Examiner* — Stanton L Krycinski
(74) *Attorney, Agent, or Firm* — Sanchelima & Associates, P.A.; Christian Sanchelima; Jesus Sanchelima

(57) ABSTRACT

A device for assisting users with mild, moderate, and severe disability, Parkinson's disease, rheumatoid arthritis, and persons healing from surgery to put on and take off clothes is disclosed. The device comprises a first telescopic pole and a second telescopic pole coupled to each other. The first telescopic pole comprises a handle at one end. The second telescopic pole comprises two hook members at one end. In operation, a user of the device couples the two hook members to a cloth and the handle is pulled up to put on the cloth.

6 Claims, 3 Drawing Sheets

(56) References Cited

U.S. PATENT DOCUMENTS

| | | | | | |
|---|---|---|---|---|---|
| 5,833,081 | A * | 11/1998 | Smith | A47G 25/0664 | 211/86.01 |
| 5,906,277 | A * | 5/1999 | Vienneau | A63C 11/026 | 206/287.1 |
| 6,948,629 | B1 * | 9/2005 | McClay | A47B 46/00 | 211/1.51 |
| 7,025,215 | B2 * | 4/2006 | Bain | A47G 25/0664 | 211/85.31 |
| 7,607,535 | B2 * | 10/2009 | Jackson | A45C 9/00 | 190/112 |
| 8,777,025 | B1 * | 7/2014 | Buckleitner | A47F 5/04 | 211/13.1 |
| 8,955,692 | B2 * | 2/2015 | Greenway | D06F 57/04 | 211/1.53 |
| 2006/0043030 | A1 * | 3/2006 | Rishar | A47B 9/14 | 211/1.51 |
| 2011/0114586 | A1 * | 5/2011 | Guzy | A47B 47/00 | 211/190 |

FOREIGN PATENT DOCUMENTS

| | | | | |
|---|---|---|---|---|
| DE | 9306708 | U1 * | 9/1993 | A47G 25/0685 |
| DE | 19964056 | A1 * | 7/2001 | A01K 63/003 |
| GB | 336693 | A * | 10/1930 | A47G 25/18 |

* cited by examiner

DEVICE FOR ASSISTING USERS

BACKGROUND OF THE INVENTION

1. Field of the Invention

The present invention relates to a device for assisting users and, more particularly, to a device that helps users to put on and take off clothes.

2. Description of the Related Art

It is known that people with limited manual dexterity because of mild, moderate and severe disability, diseases, such as multiple sclerosis (MS), rheumatoid arthritis, and Parkinson's disease, and those recovering from injury, particularly of the lower extremities find it extremely difficult to put on and take off their clothes such as undergarments, pants, and skirts. Further, when a person with limited manual dexterity tries to put on and take off clothes, there is a risk of injury to the person. In order to avoid injury to the person, a caretaker may be needed to assist the person with limited manual dexterity to change clothes or to do other tasks.

In order to address the problem of assisting the people with limited manual dexterity, several devices have been proposed in the past that the people can use to put on and take off their clothes. For example, United States Patent Application US20100193554A1 titled "Device to help with dressing" discloses a device that helps the user to pull up trousers. In US20100193554A1, the device consists of a base plate with two vertically fixed arms. The device is designed to allow the user to attach his or her pants to the upright arms and feed the pants on to the arms. The device is then lowered to the floor by means of a strap and then the device is pulled into correct position to allow the user to put their feet through the pants.

It should be understood that the above design has several problems. The device discussed above requires assistance of a caretaker if the device has to be used by an aged person. Further, the device requires manual effort to pull the device to put on the pants. The user may loose balance while using the device and may get injured.

Other documents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a device that people with physical difficulties can use for putting on and taking off clothes without any difficulty.

It is another object of this invention to provide a device comprising a first telescopic pole and a second telescopic pole. The first telescopic pole comprises a handle at one end and is coupled to the second telescopic pole at other end. Further, the second telescopic pole comprises two hook members at one end. The second telescopic pole is designed to retract into inner surface of the first telescopic pole when operated by a user or using a battery.

It is another object of this invention to provide a device comprising at least one telescopic pole comprising a handle at one end and two hooks at other end.

It is yet another object of the present invention to provide a device that helps users to have better balance while getting dressed and make the task of putting on and taking off clothes easier.

It is yet another object of the present disclosure to provide a device for assisting users with mild, moderate, and severe disability, Parkinson's disease, rheumatoid arthritis, persons healing from surgery and so on.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

The following detailed description is intended to provide example implementations to one of ordinary skill in the art, and is not intended to limit the invention to the explicit disclosure, as one or ordinary skill in the art will understand that variations can be substituted that are within the scope of the invention as described.

Figure 1:
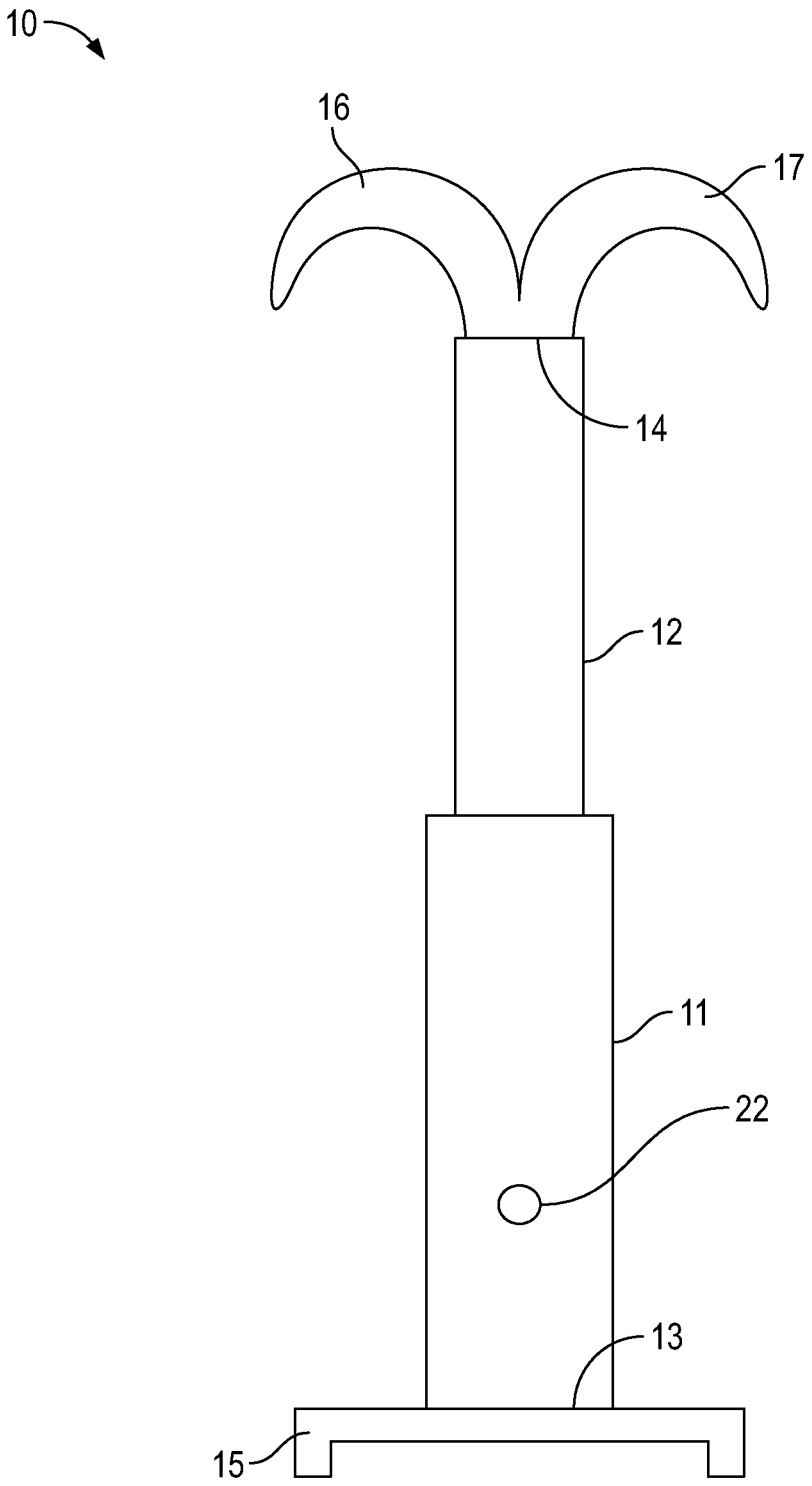
FIG. 1 illustrates a front view of a device for assisting users, in accordance with one embodiment of the present disclosure.

Referring now to FIG. 1, a front view of a device 10 used for assisting users to put on and take off clothes is shown, in accordance with one embodiment of the present disclosure. The device 10 comprises a first telescopic pole 11 and a second telescopic pole 12. Each of the first telescopic pole 11 and the second telescopic pole 12 may be made up of plastic or metal such as aluminum or stainless steel.

In one implementation, the first telescopic pole 11 comprises a first distal end 13. Similarly, the second telescopic pole 12 comprises a second distal end 14. The device 10 further comprises a handle 15 provided at the first distal end 13 of the first telescopic pole 11. The device 10 comprises a first hook member 16 and a second hook member 17 extended from the second distal end 14 of the second telescopic pole 12.

Figure 2:
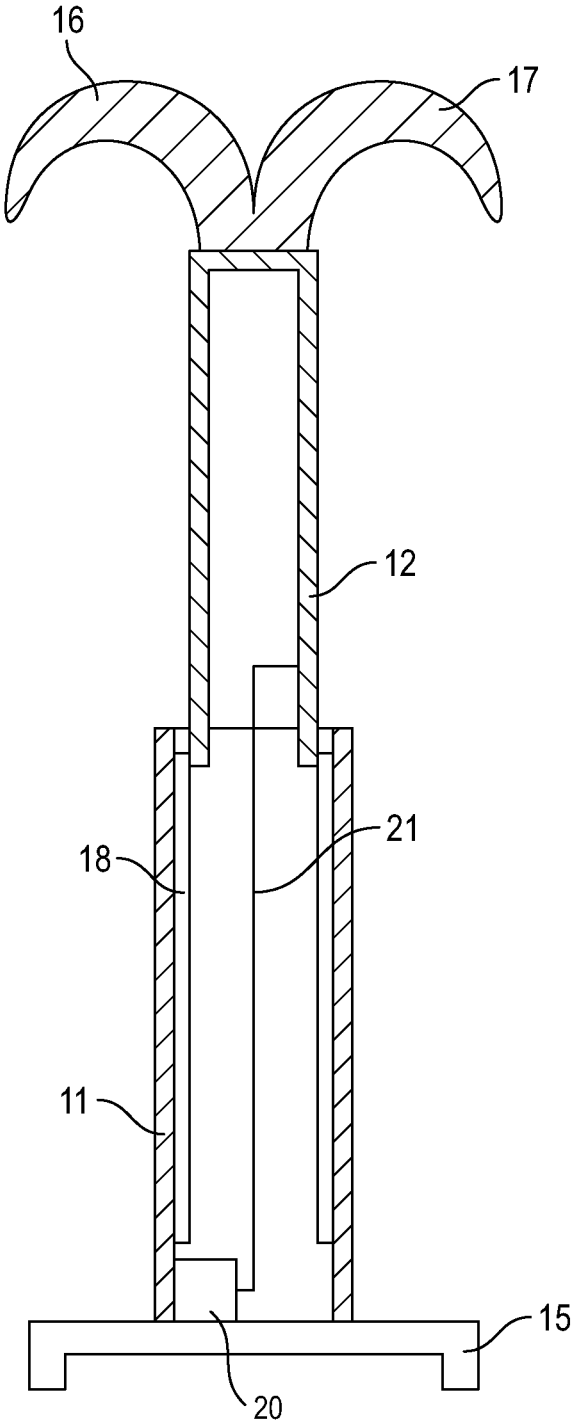
FIG. 2 shows a cross-sectional view of the device, in accordance with one exemplary embodiment of the present disclosure.

Now referring to FIG. 2, a cross-sectional view of the device 10 is shown, in accordance with one embodiment of the present disclosure. As can been, the first telescopic pole 11 comprises a rail 18 at its inner surface. It should be understood that the outer diameter of the second telescopic pole 12 is less than inner diameter of the first telescopic pole 11. Specifically, the second telescopic pole 12 is coupled to the first telescopic pole 11 via the rail 18. The second telescopic pole 12 is made to slide up and down such that length or height of the device 10 can be adjusted. In order to reduce the length of the device 10, the second telescopic pole 12 is made to retract into the inner surface of the first telescopic pole 11.

In one implementation, the device 10 comprises a battery 20 provided at inner portion of the first telescopic pole 11. Further, the battery 20 comprises a connector 21 coupled to the second telescopic pole 12.

Referring to FIG. 1 and FIG. 2, the device 10 further comprises a button 22 provided at outer surface of the first telescopic pole 11. In order to operate the device 10, a user of the device 10 may press the button 22 to operate the battery. When the user presses the button 22, the battery 20 pulls the connector 21, which in turn pulls down the second telescopic pole 12 into the inner surface of the first telescopic pole 11. In order to increase the length or the height of the device 10, the user may manually pull up the second telescopic pole 12 from inner surface of the first telescopic pole 11, by holding one of the first hook member 16 or the second hook member 17 or outer surface of the second telescopic pole 12.

In one implementation, the device 10 height can be adjusted without manually pulling the second telescopic pole 12. In order to increase the height of the device 10, the user may press the button 22 for a long time e.g., three seconds and the battery 20 may engage the connector 21 such that the connector 21 pushes up the second telescopic pole 12 from inner surface of the first telescopic pole 11.

Figure 3A:
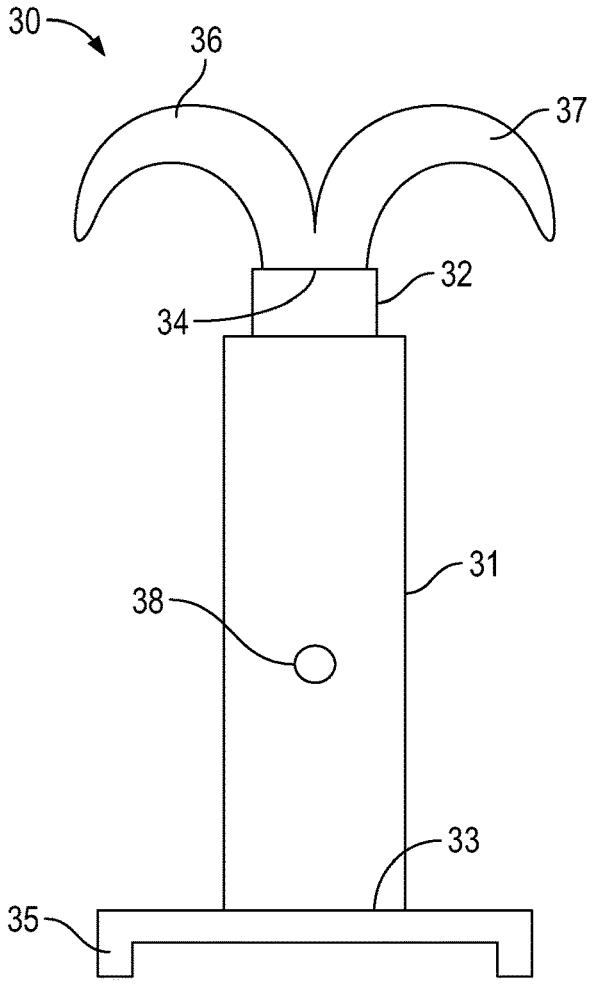
FIGS. 3A and 3B illustrate a device for assisting users with varying height, in accordance with another exemplary embodiment of the present disclosure.
Figure 3B:
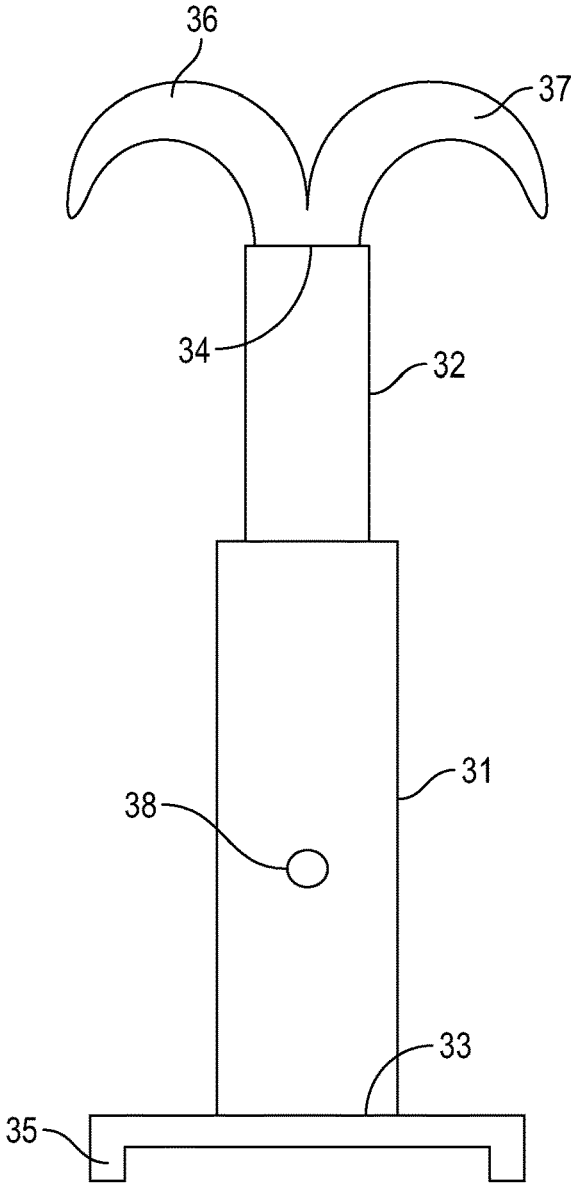

Referring to FIGS. 3A and 3B, a device 30 for assisting users to put on and take off clothes is shown. The device 30 comprises a first telescopic pole 31 and a second telescopic pole 32. The first telescopic pole 31 comprises a first distal end 33. Similarly, the second telescopic pole 32 comprises a second distal end 34. The device 30 further comprises a handle 35 provided at the first distal end 33 of the first telescopic pole 31. The device 30 comprises a first hook member 36 and a second hook member 37 extended from the second distal end 34 of the second telescopic pole 32. Further, the device 30 comprises a button 38 provided on outer surface of the first telescopic pole 31. Further, the device 30 comprises a battery (not shown, similar to battery 20 in FIG. 2) comprising a connector (not shown) connecting the second telescopic pole 32. Referring to FIG. 3A, the second telescopic pole 32 retracted into inner surface of the first telescopic pole 31 is shown. Referring to FIG. 3B, the second telescopic pole 32 extended on top of the first telescopic pole 31 is shown. It should be noted that the height of the device 30 may be adjusted by the user by manually pulling the second telescopic pole 32. In order to reduce the height of the device 30, the user of the device 30 may press the button and adjust the height of device 30.

In order to put on or take off clothes such as undergarment, the user may sit or stand. Considering that the user stands to put on the cloth, at first, the user may adjust the height of the device 30. Specifically, the user may manually pull the second telescopic pole 32 to increase the height of the device 30. In an alternate embodiment, the user may press the button to increase the height of the button. After adjusting the height of the device 30 to desired length, the user may keep his or her right foot flat on floor. Subsequently, the user may connect the first hook member 36 to left undergarment. Further, the user may keep his or her left foot flat on the floor. Subsequently, the user may connect the second hook member 37 to right undergarment. After connecting the first hook member 36 to left undergarment, and the second hook member 37 to right undergarment, the user may press the button 38 such that the second telescopic pole 32 retracts into the inner surface of the first telescopic pole 31. As the second telescopic pole 32 retracts into the inner surface of the first telescopic pole 31, the undergarment is also pulled up onto hips of the user. Similarly, the user may connect the first hook member 36 to left undergarment, and the second hook member 37 to right undergarment and press the button 38 to increase the height of the device 30 in order to take off the undergarment.

As the device 30 is operated with the help of the battery 38, the user can use the device 30 without losing balance while getting dressed. Further, the device 30 facilitates in increased balance and decreases risk for tasks that require the individual to shift weight to one foot such as when putting on undergarments, pants, and skirts. Furthermore, the user may adjust the height of the device 30 as per need e.g., to put on clothes or take off while sitting or standing.

When not in use, the second telescopic pole may be retracted into first second telescopic pole, and the device may be stored in a corner of a house such that the device does not become a tripping point. In addition, the two handed design would increase safety and decrease risk of overuse injuries for caretakers attending to the needs of the user i.e., a patient with compromised balance or lower extremity weakness.

Although the above description is explained to have a device with two telescopic poles i.e., a first telescopic pole and a second telescopic pole, it should be obvious to a person skilled in the art to provide a single telescopic pole that comprises a handle at one end and two hook members i.e., a first hook member and a second member at other end. The single telescopic pole may be provided with a connector to extend the height of the device.

It should be understood that people with physical difficulties might use the device for putting on and taking off clothes without any difficulty. Further, the assistants or caretakers may use the device to assist the patient to put on and take off the clothes without much difficulty. As such, the device is used for assisting users with mild, moderate, and severe disability, Parkinson's disease, rheumatoid arthritis, persons healing from surgery and so on.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A device to assist users donning clothing on and off, comprising:

a. a first telescopic pole member having a first distal end being the bottommost end;

b. a second telescopic pole member having a second distal end being the topmost distal end;

c. a first and second hook member both extending entirely out from said topmost distal end;

d. said second telescopic pole housed within said first telescopic pole, said second telescopic adapted to extend upwards out of said first telescopic pole through both automatic or manual means;

e. a rail coupling said first and second telescopic pole;

f. a motor configured to drive said second telescopic pole up and down along said rail;

g. a button adapted to allow a user to extend or retract said second telescopic pole;

h. a battery used to power said motor upon being actuated by said button;

i. a handle mounted to said bottommost end of said first telescopic pole member;

j. said first and second hook members both being curved towards said handle; and k. said handle includes two lateral distal ends opposite each other, said two lateral ends extend opposite from said bottom end.

2. The device to assist users donning clothing on and off of claim 1 wherein said first telescopic pole has an inner portion, said battery is located at the inner portion of said first telescopic pole.

3. The device to assist users donning clothing on and off of claim 1 wherein said battery is connected to said second telescopic pole.

4. The device to assist users donning clothing on and off of claim 1 wherein said first and second hook members are identical.

5. The device to assist users donning clothing on and off of claim 1 being movable thereby being portable.

6. The device to assist users donning clothing on and off of claim 1 wherein users can manually extend said second telescopic pole by manually pulling on said second telescopic pole.

* * * * *